United States Patent [19]

Safianoff

[11] 4,234,095

[45] Nov. 18, 1980

[54] COLLECTION CONTAINER FOR STERILE LIQUIDS

[75] Inventor: Albert Safianoff, Rancho Palos Verdes, Calif.

[73] Assignee: Alpha Therapeutic Corporation, South Pasadena, Calif.

[21] Appl. No.: 13,446

[22] Filed: Feb. 21, 1979

[51] Int. Cl.[3] ..... B65D 41/20

[52] U.S. Cl. ..... 215/232; 156/73.1; 215/308; 215/309; 128/272

[58] Field of Search ..... 141/286, 329, 330; 215/232, 250, 253, 308, 309; 128/272, 272.3, 214 D; D24/56

[56] References Cited

U.S. PATENT DOCUMENTS

| | | | |
|---|---|---|---|
| D. 236,918 | 9/1975 | McPhee | D9/10 X |
| 3,215,299 | 11/1965 | Coanda | 128/272 X |
| 3,525,454 | 8/1970 | Frederiksen | 156/73.1 X |
| 3,602,257 | 8/1971 | Berleyoung | 156/73.1 X |
| 3,878,962 | 4/1975 | Holbrook | 215/309 |
| 3,920,503 | 11/1975 | Keeler | 215/232 X |
| 3,938,686 | 2/1976 | Milligan | 215/232 |
| 3,944,261 | 3/1976 | Reed | 156/73.1 X |
| 3,952,902 | 4/1976 | Prouty | 215/308 X |
| 3,957,168 | 5/1976 | Shine | 215/1 C |
| 4,049,034 | 9/1977 | Vcelka | 215/232 X |

*Primary Examiner*—Donald F. Norton
*Attorney, Agent, or Firm*—Christie, Parker & Hale

[57] ABSTRACT

A collection container 10 for sterile liquids, such as blood plasma, of a thermoplastic material having specially designed receptacles in the top for receiving the connecting tubes of a liquid transfer apparatus and for providing a permanent venting arrangement. The container comprises a bottle body 12 of clear polypropylene and a top portion 14 secured to the mouth of the body having pre-formed sleeves 34, 36, 40 depending from the interior side of the top. One of the sleeves 40 provides a venting aperture and locates a plug of venting material. The other sleeves 34, 36 receive the connecting tubes or plungers 38 of the transfer apparatus. The top portion and mouth of the bottle are provided with mating protuberances 42, 44 to facilitate joining by sonic welding.

14 Claims, 5 Drawing Figures

Fig. 2
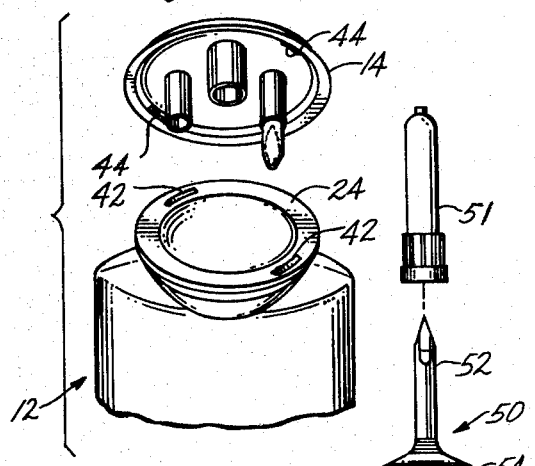
Fig. 3
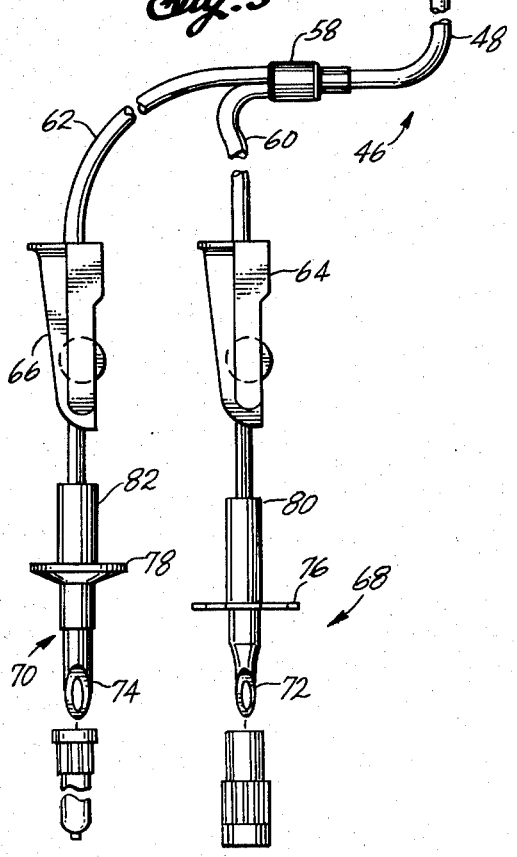
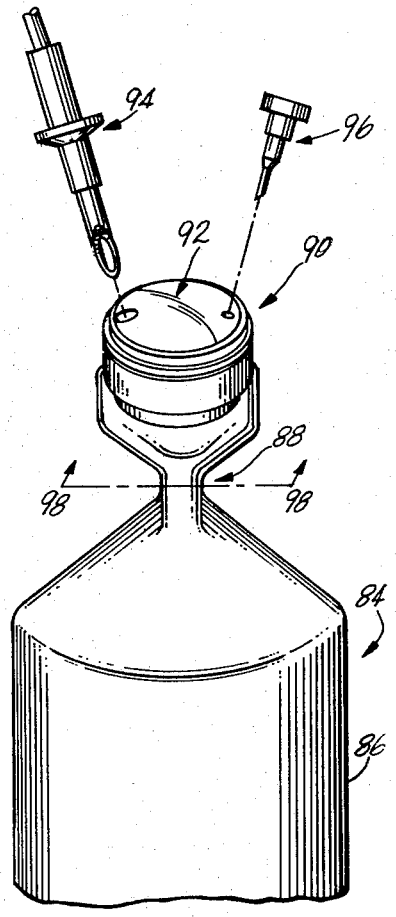
Fig. 4 PRIOR ART
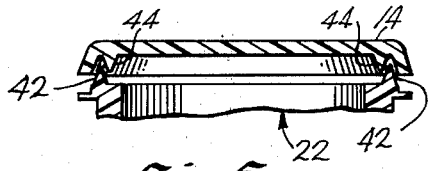
Fig. 5

COLLECTION CONTAINER FOR STERILE LIQUIDS

DESCRIPTION OF THE PRIOR ART

The present invention relates to plastic containers for sterile liquid collection and in particular to bottles for pooling plasma and other large-volume parenteral solutions.

In the collection and distribution of sterile liquids such as blood plasma and other fractions of human blood, the use of special containers is required to provide relatively large-volume receptacles for convenient handling of such liquids while ensuring their complete sterility as they are collected and transferred. Typical of the containers currently in use is a plastic bottle fabricated from linear high-density polyethylene, which is generically described as a plasma pooling bottle. Because such a bottle is fabricated of polyethylene, it is characterized by a condition of opaqueness which makes it difficult to see the contents of the bottle and to make precise visual observations as to the amount of liquids collected therein. The bottle is further characterized by the fact that it is a molded single piece of material, having a body portion terminating in a narrow constricted oblong neck portion and a cylindrical top portion extending from the neck portion. The top portion is generally formed in the shape of a cap for the bottle with the upper or exterior surface of the cap being slightly rounded.

In use, liquids are introduced into the bottle by an operator grasping the bottle and forcibly pushing a pointed plunger of a liquid transfer apparatus through the rounded exterior surface of the top portion of the bottle. The plunger is typically a hollow tube truncated at an angle to the axis of the tube to provide a point at the tip. Flexible tubing is connected to the opposite end of the plunger, which extends to a source of liquid to be introduced into the bottle. To provide venting while fluids are being introduced into the bottle, a second smaller plunger with a pointed end is also forcibly driven through the top of the bottle. The second auxiliary plunger is a hollow tube of smaller diameter and is characterized by the provision of a small wad or pledget of cotton, which is placed in the free open end of the auxiliary plunger. The function of the second plunger and the pledget of cotton is to provide an escape for air entrained within the bottle as fluids are introduced therein, while still maintaining the sterility of the interior of the bottle and the contents that are being introduced into it.

A collection container of the above type is characterized by several problems that make it unsatisfactory. Because the bottle and plungers are fabricated of plastic materials, and the top or cap portion of the bottle is somewhat rounded, a frequent problem is that the user encounters difficulty in forcing the pointed plunger of the liquid transfer apparatus through the top of the bottle. The rounded top of the bottle makes it difficult to find a point of purchase for the pointed plunger with the result that the plunger slides or slips as the user is trying to force it through the plastic top of the bottle. It is not unusual for the sharp-pointed plunger to slip and nick or cut the other hand of the user as he grasps the bottle around the body or around the neck. Where the container is used in the collection of human blood and the like, such an injury poses a substantial risk of exposing the user to hepatitis. Likewise, the possible contamination of the liquid transfer apparatus, or transfer set as it is referred to, requires that it be discarded and a new one obtained.

Another reason why difficulties are encountered in puncturing the top of a bottle is that the molding process by which the bottle is fabricated is one which is difficult to control to a close tolerance so that the thickness of the walls of the bottle and various parts thereof, in particular the top, vary considerably. Ths non-uniformity produces situations where some parts of the top are thicker than others, making it more difficult to puncture this part with a sharp-pointed plunger.

The auxiliary venting tube is also a source of problems. It develops that, in use, it is not unusual for the pledget of cotton to be expelled or dislodged from the auxiliary plunger, thereby exposing the contents of the bottle by means of an unobstructed conduit to the outside atmosphere, resulting in contamination of the contents of the bottle and forcing the discarding of the liquids contained therein.

As indicated above, the typical prior art bottle has a narrow oblong neck. This narrow neck provides a location for sealing the bottle after liquid has been collected therein. In use, the bottle is connected by means of the transfer set to a source of sterile liquids that are to be placed in the bottle. The user drives the pointed plunger at the bottle end of the transfer set into the top of the bottle and, in turn, connects the opposite end of the transfer set to a source of the liquid, e.g., plasma, to be placed into the bottle. The vent tube is also driven through the top of the bottle. The fluid is then introduced into the bottle, either by draining under gravity flow from supply containers, such as the bag-like containers now used to collect human blood or plasma, or is pumped therein. Once the liquid has been collected to the desired volume, the supply is cut off. Thereafter, the narrow, constricted neck of the bottle is cut to remove the top and, at the same time, is sealed along the cutting line by special equipment to provide an airtight seal of the bottle and the contents within.

The cutting and sealing operation is also characterized by problems which flow from the molding process for fabricating the bottle. As in the case of the top, the neck of the bottle and the material therein experience a significant variation of thickness with too much of the plastic material being concentrated in the center portion of the neck and a much thinner amount of material at the edges. Such a variation in thickness places a heavy burden on the sealing equipment and sometimes results in a situation where the bottle is not completely and securely sealed. Sometimes the faulty seal can be discovered and the liquid retransferred without harm. In other cases, however, the problem is not detected until the bottle is used at some later point in time, usually requiring discarding of the contents because of contamination.

Further steps of processing such liquids call for the freezing of the liquid within the bottle to facilitate shipping. Often, when exposed to a freezing bath or refrigeration, latent defects in the seals are encountered. When the container is subjected to the cold temperature required to freeze the liquid contained within the bottle, thermal stresses are set up in the bottle material which cause it to contract and to distort, a problem which is exacerbated by the variation in wall thicknesses in various parts of the neck of the bottle. If a seal is weak or inadequate, frequently the seal opens and exposes the contents to contamination.

The process whereby the prior art bottles are sealed is also characterized by problems connected with the sealing equipment itself. To date, such equipment has been found to be difficult to maintain and subject to breakdown on frequent occasions. The maintenance problems have been so severe that, as a result, it has been necessary to have a backup sealing machine available at all times at locations where the containers are used. The maintenance problems and redundancy requirements are obviously factors in the high cost of the liquid collection system in which this type of container is used.

SUMMARY OF THE PRESENT INVENTION

The present invention provides a vessel or container for collecting and pooling fluids, particularly sterile fluids, that provides several significant advantages in comparison to the type of container heretofore available. The container according to the present invention is characterized by an essentially transparent body, permitting easy observation of the contents within the container for both visual observation of the condition of the liquid stored therein and the volume at any given instant of observation. In addition, it eliminates entirely the necessity for removing the top portion of the bottle along a line through a constricted neck portion and the sealing of the container along this line to obtain a liquid-tight closure of the vessel. Elimination of this method of closing the container provides significant advantages in the handling of the container itself and in eliminating the troublesome and breakdown-prone sealing equipment heretofore required with the prior art container. These and other advantages are provided by the present invention as the discussion which follows will more clearly indicate.

The invention provides a collection container for sterile liquids comprising an elongated, tapering, hollow body of a clear thermoplastic material. The body has a neck portion at one end and means for racking the container at the opposite site end. The neck portion terminates in an aperture opening into the body. A top is secured to the aperture by means of a sterile, liquid-tight connection, the top having at least one sealed, hollow sleeve depending therefrom and extending interiorly of the neck portion for receiving and securely mounting a hollow tube to conduct liquid into the interior of the container.

In addition to the advantages outlined above, the container of the present invention is characterized by a flat top of uniform thickness, which reduces substantially the tendency of a pointed plunger or tube to slip or slide over the top when a puncture is being made in the top to connect the tubing of the liquid transfer apparatus to the container for transferring liquid therein. In addition, by the design of the present container, one or more sleeves are integrally formed with the top on the interior surface thereof so that, when attached to the main body of the container, the sleeves extend down into the interior of the container. These sleeves define targets for plunger placement from the exterior of the top and hollow cylindrical guides on the interior thereof for holding the tubular plunger of the transfer set securely in place. By proper dimensioning of the sleeves, a solid and secure tubular mounting for the plunger is provided, characterized by a high degree of friction, which makes it essentially impossible for the plunger to accidentally dislodge or come loose.

The top is also provided with an additional tube or sleeve extending therethrough for providing the means whereby permanent venting of the container can be obtained. By inserting and permanently sealing a plug of a fibrous material in this sleeve, venting on a permanent basis is obtained, while maintaining sterility. Provision of venting in this manner eliminates the need for the auxiliary plunger of the prior art container. The telescoping force-fitting of the plug of sterile fibrous material in the venting sleeve presents a structure in which it is essentially impossible to remove or dislodge the filtering material, thereby eliminating the possiblity of contamination occurring due to the loss of the plug or pledget of cotton in the prior art auxiliary venting plunger.

Still another advantage of the present invention is the solid, secure, fluid-tight connection of the top to the body portion of the container. To accomplish this, the top surface of the opening of the bottle and the undersurface of the top which is attached to the bottle are provided with specially-configured ridges which are matingly aligned to enable the bonding of the top to the bottle by means of sonic welding. Thus, an important aspect of the invention is that it provides a means whereby olefinic polymeric materials can be joined together by means of sonic welding in a reliable liquid-tight connection.

The sealing of the present container after it has been filled also involves significant advantages in comparison to the prior art container. As noted, the prior art required the detachment of the top portion of the bottle at the neck and the sealing of the bottle along that line. With the container of the present invention, this method of sealing is eliminated entirely. Instead, because of the solid, secure, fluidtight connection of the plungers of the transfer set in the sleeves provided in the top, sealing is accomplished by cutting and sealing the flexible tubing of the liquid transfer apparatus connecting the supply containers to the collection container of the present invention at a point just beyond the end of the rigid plunger which is engaged with the container. By tying or sealing the flexible tubes of the transfer set, a complete, sterile, reliable seal is obtained. Thereafter, when the bottle is further processed, such as by subjecting it to cold temperatures to freeze the plasma or other sterile liquid contained therein, no distortion effects are encountered at a seal along the neck of the bottle which might have a tendency to twist or deform and open. Likewise, the provision of a permanent vent is also of importance in preventing the bottle from distorting during treatment such as when subjected to low-temperature baths, or when the liquid contained therein is being thawed.

DESCRIPTION OF THE DRAWINGS

These and other advantages of the present invention will be better understood by reference to the figures of the drawing, wherein:

FIG. 2 is an exploded detail view of the top opening of the container and the flat top which is affixed thereto;

FIG. 3 is a plan view of a transfer set for supplying sterile liquids from supply containers to the collection container of the present invention;

FIG. 4 is a perspective view of a container according to the prior art, showing means by which the transfer set and auxiliary vent are connected thereto; and FIG. 5 is a detail schematic type of view illustrating the joining of the bonding ridges on the interior of the top and the ridges on the mouth of the container.

DESCRIPTION OF THE SPECIFIC EMBODIMENT

Figure 1:
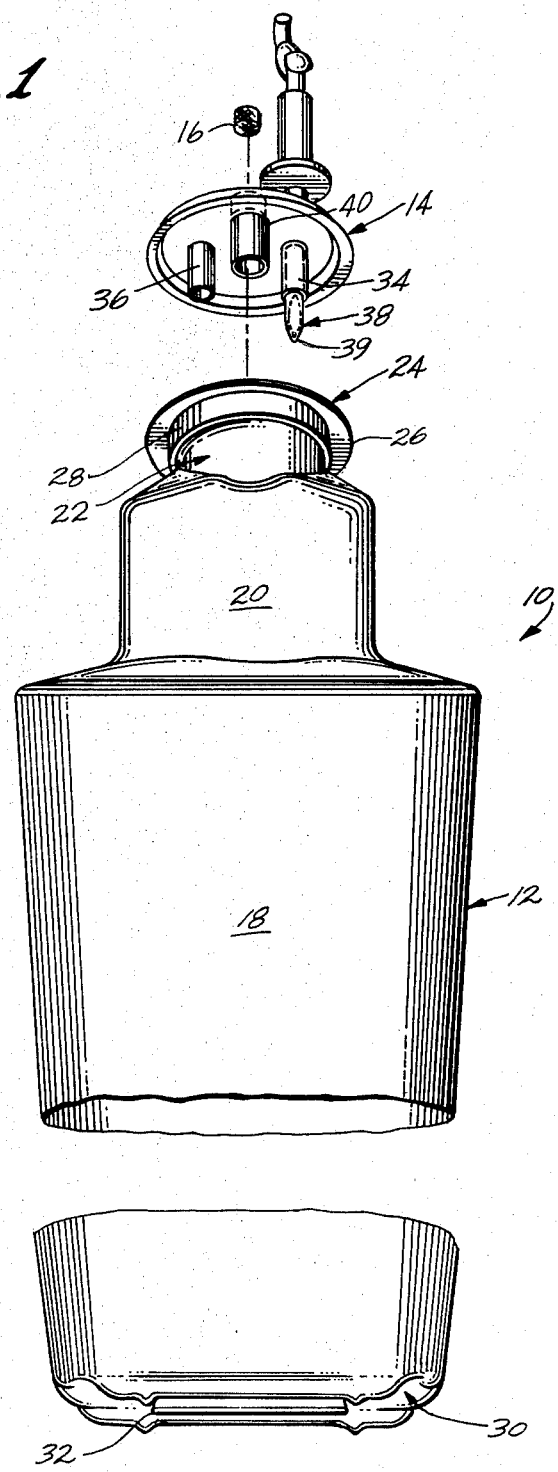
FIG. 1 is an exploded perspective view of a container according to the present invention, showing the body of the bottle, the flat top having integral sleeves depending therefrom, and the plug of filtration material.

A container 10 for sterile liquids according to the present invention is shown in an exploded view in FIG. 1. As shown therein, the container comprises a body portion 12, a top portion 14, and a cylinder or cylindrical segment 16 of a fibrous filtration material. The body portion 12 and top portion 14 are fabricated from a thermoplastic, preferably a polypropylene copolymer. The body portion 12 is fabricated by a blow-molding process with biaxial orientation to provide transparency of the bottle walls. The top portion 14 is injection-molded to closely control the dimensions of the material and the geometry thereof, particularly the flatness of the top. As seen in FIG. 1, the body portion 12 comprises an elongated portion 18, which is oblong in cross-section and has a decreasing taper from top to bottom. The taper of portion 18 facilitates the removal of the contents when frozen. To remove the contents, the bottle is cut along a line through portion 18 and inverted to allow the contents to slide out.

Joined to and integrally formed with body portion 18 is a neck portion 20, which is essentially elliptical in cross-section. A short cylindrical structure 22 extends up from neck portion 20 to define the opening into the container. Cylindrical structure 22 includes a circular ring 24 having a flange 26 and a necked-down portion 28 of a diameter smaller than the diameter of flange 26.

The bottom of body portion 12 is formed to define a channel 30, extending along the long axis of the oblong body portion, and a rib or bar 32 located in the center of channel 30 extending downwardly therefrom, having an undercut configuration providing the means whereby bar 32 can be engaged in the slot of a device for carrying or racking the container 10 in an upside-down configuration.

Shown above the top opening of the container 10 is circular top portion 14, which is injection molded to a somewhat larger overall thickness than the wall thickness of the body portion 12. Integrally formed in the underside of top 14 is a first cylindrical sleeve 34 and a second cylindrical sleeve 36. In its assembled unused configuration, the exterior surface of top portion 14 is one continuous, unbroken section of the polypropylene material to close and seal sleeves 34 and 36 from the exterior of the container. The sleeves are selected of a diameter so as to receive a pointed plunger 38 in a liquid-tight, force-fitted, frictional relationship when the plunger 38 is inserted into the top of the container. To engage plunger 38, the user of the container grasps body portion 12 in one hand and forcibly applies the point 39 of the plunger 38 to top portion 14 directly above sleeve 34 or 36 so as to pass through the top thereof into one of the sleeves. The flat configuration of the top of the container substantially reduces the tendency of the point 39 to slide or slip to the side and thereby reduces substantially the chances of the occurrence of injury to the user with the attendant risks referred to previously.

Also shown depending from the interior side of top portion 14 is a third sleeve 40 which, in the preferred embodiment, extends exteriorly of the exterior surface of top 14. Sleeve 40 is a cylindrical receptacle for receiving the plug of the fibrous filtration material 16. This material, which, in the presently-preferred embodiment, is fabricated of a fiberglas Teflon material, is sometimes referred to as a "depth filter". It provides a sterile venting for the contents of the interior because of its fibrous nature. Bacteria cannot pass through fibers of the plug of filtration material 16, because bacteria move in straight lines, and the random pattern of the fibers of the filter prevent the bacteria from penetrating to the interior of the container. The provision of a permanent airway into the interior of container 10 by means of sleeve 40 and filter 16 prevents distortion of the bottle when subjected to low temperature baths, etc.

As seen in the views of FIGS. 2 and 5, which is a detail view of the top of container 10 and top portion 14, the top surface of ring 24 is provided with a pair of ridges 42, which are preferably triangular in cross-section and resemble elongated pyramids. A pair of corresponding ridges 44 of similar shape are provided on the underside of top portion 14. When top 14 is placed on ring 24, ridges 44, which can be discontinuous as shown, or circumferential are aligned with ridges 42 similarly configured along the interior side thereof and provide the means whereby the top can be sonicly welded to the body of the container. In contrast to the prior art methods of attaching two parts of olefinic polymer material, such as polypropylene, where it has been required to use heat to melt the plastic to obtain a solid joint, the present invention utilizes sonic welding to accomplish the joinder. The ability to use sonic welding to accomplish the bond enables the use of polypropylene in the body of the container, thereby enabling the provision of an essentially transparent container. Whereas, heretofore olefins have tended to absorb the vibrations of a sonic welder, rather than convert such vibrations to heat to accomplish the bonding, the provision of ridges 42 and 44 provides locations at the contact of the ridge with the opposite surface where a point of heat concentration is created, enabling the joinder of the two parts and providing a structurally secure bond at this point and a liquid-tight seal around the entire periphery of the underside of the top to the top surface of the ring 24.

A liquid transfer set 46 is shown in FIG. 3. The liquid transfer set comprises a length of tubing 48 terminating in a rigid plunger 50, having a pointed end 52, an enlarged circular flange 54 disposed about the plunger 50 approximately in the center thereof, and a tube portion 56 extending away from flange 54 for receiving flexible tubing in a telescoping relation therewith. A cap 51 is placed over plunger 50 when not in use. Attached at the opposite end of tubing 48 is a coupling unit 58 for receiving inputs from two separate streams and combining same into a single flow to be directed through tube 48. Similar lengths of flexible tubing 60 and 62 extend from the double openings on the opposite side of coupling unit 58 through valving units 64, 66 to rigid plungers 68, 70. Plungers 68 and 70 have configurations similar to plunger 50 in that they have pointed ends 72, 74, respectively, enlarged circumscribing flanges 76, 78, respectively, and tube portions 80, 82, respectively, extending rearwardly from discs 76, 78 to receive tubing in a liquid-tight seal. Caps 69, 71 cover plungers 68, 70 when not in use.

The transfer set is used by engaging plungers 68 and 70 in supply containers such as the flexible bags used to collect human blood, and the plunger 52 in one of the input sleeves at the top of container according to the present invention. By hanging the plasma bags above the container and controlling the flow by means of valving units 64 and 66, the fluids contained in the supply containers are drained under gravity flow or pressured into container 10 for storage prior to further handling or shipping.

A prior art plasma pooling bottle is shown in FIG. 4. In one particular embodiment of such a container currently in use, the container is formed of a blow-molded, linear, high-density polyethylene and is essentially opaque in construction. As shown in FIG. 4, a container 84 comprises a body portion 86, which is essentially circular in cross-section, a constricted neck portion 88, which is generally elliptical in cross-section, terminating in a cylindrical structure 90 capped by a closed, rounded top 92. Because of the difficulty of holding tolerances in molding such a body, particularly at points of changing angles and indentations, the wall thicknesses of neck portion 88 and top structure 90 varies substantially.

When it is desired to introduce a liquid into the container, a plunger, such as plunger 94, is brought to bear against top 92 of the container. Because of the rounded, somewhat uneven surface of the top portion, the user encounters difficulty in forcing the plunger through the top, and it sometimes slips off to the side, possibly injuring the user. Because it is necessary to vent the interior of the container when liquid is being introduced therein, an auxiliary plunger 96 is provided, and similar difficulties are encountered in engaging this plunger with the top of the container. In the prior art, auxiliary plunger 96 has had a plug or pledget of cotton stuffed in the exterior end of the plunger 96 to provide a filtering function and prevent contamination of the sterile fluid introduced into the container. This pledget of cotton has been found to be subject to dislodgement with the subsequent contamination of the contents of the container when this dislodgment occurs.

Once the container is filled to the desired level, it is sealed by means of a sealing machine which cuts off the top 90 of the container along sealing line 98 and at the same time seals the walls of the constricted neck portion 88 together. Because of the unevenness and disparities in thickness of the walls of the neck portion 88 in the center and at the edges, difficulties in obtaining a reliable seal are constantly encountered. Similarly, when the container is sealed and placed in a low-temperature environment, such as a dry ice alcohol bath to freeze the contents, thermal stresses are set up in the container which cause the seal to break, subjecting the contents to contamination.

In general, the prior art container is subject to three major drawbacks. It was difficult to obtain a reliable seal, particularly when the bottle experienced thermal stresses during the freezing operation. The sealing mechanism used with such bottles was difficult to maintain and keep in operation, thereby adding a significant element of cost to the use of a system employing such bottles and sealers, normally necessitating the requirement of a standby sealer, as well as the operating sealer. Finally, because of the opaque quality of the polyethylene material, it was impossible to see into the interior to examine the condition of the contents and the level. In contrast, the present invention eliminates the necessity for sealing the bottle at the neck portion, and instead, substitutes the sealing of the tubing of the transfer set while leaving the plungers in place in the sleeves which are part of the top of the container. The flat top of the container eliminates the difficulties of inserting a plunger therein, and the use of sleeving in the interior of the top provides the mechanism where the pulling out or dislodgement of the plunger is essentially eliminated. Finally, the provision of a permanent vent eliminates the necessity for the insertion of venting mechanism, and the improvement in the construction of the vent prevents the loss of the filtering material and the possible contamination of the contents. When transfer of fluid has been accomplished, the container, being of a disposable material, is emptied and discarded.

What is claimed is:

1. A collection container for sterile liquids comprising:

an elongated tapering hollow body of clear thermoplastic material, having a neck portion at an upper end, said neck portion terminating in an opening into the container;

a flat disc-shaped closure fixedly locked to the opening with a sterile liquid tight connection to maintain the interior of the container sterile, said closure having at least one hollow sleeve depending therefrom and extending interiorly of the neck portion for receiving and securely mounting a hollow tube inserted therein to conduct liquid to the interior of the container, a permanent puncturable seal closing the hollow sleeve at the point of juncture of the sleeve and the closure, and;

filtered venting means formed into the closure communicating between the interior and exterior of the container.

2. A container according to claim 1 wherein the venting means is a second sleeve formed in the closure, extending interiorly of the body and exteriorly of the closure, and a plug of fibrous material located within the second sleeve.

3. A container according to claim 2 wherein the plug of fibrous material is permanently sealed within the second sleeve.

4. A container according to claim 2 having a second sealed hollow sleeve depending from the closure and extending interiorly of the neck portion for receiving and securely mounting a hollow tube inserted therein.

5. A container according to claim 4 wherein the body is fabricated of an olefinic polymer.

6. A container according to claim 5 wherein the olefinic polymer is polypropylene.

7. A container according to claim 6 wherein the body portion is fabricated by a blow-molding process with biaxial orientation.

8. A container according to claim 4 including a second permanent seal closing said second hollow sleeve.

9. A container according to claim 1 wherein the closure is secured to the body by means of sonic welding.

10. A container according to claim 9 wherein the closure is fabricated of injection-molded polypropylene.

11. A container according to claim 10 wherein mating ridges are provided on the underside of the closure and on the upper surface of the neck portion and are aligned in a juxtaposed relationship when the closure is placed on the neck portion to facilitate joinder by sonic welding.

12. A container according to claim 1 wherein the seal is integrally formed with the closure.

13. A container according to claim 12 wherein the closure and seal are molded to a predetermined degree of flatness on the exterior side of the container.

14. A container according to claim 1 including means formed in the bottom of the container for carrying said container.

* * * * *